US012534904B2

(12) United States Patent
Simon, III

(10) Patent No.: US 12,534,904 B2
(45) Date of Patent: Jan. 27, 2026

(54) ADAPTIVE BUILDING SYSTEM AND PARTS

(71) Applicant: Peter Arthur Simon, III, Mauston, WI (US)

(72) Inventor: Peter Arthur Simon, III, Lyndon Station, WI (US)

( * ) Notice: Subject to any disclaimer, the term of this patent is extended or adjusted under 35 U.S.C. 154(b) by 0 days.

(21) Appl. No.: 18/972,821

(22) Filed: Dec. 6, 2024

(65) Prior Publication Data

US 2025/0188734 A1 Jun. 12, 2025

Related U.S. Application Data

(60) Provisional application No. 63/607,866, filed on Dec. 8, 2023.

(51) Int. Cl.
*E04B 1/343* (2006.01)
*E04B 1/61* (2006.01)
*E04B 1/76* (2006.01)

(52) U.S. Cl.
CPC ..... *E04B 1/34321* (2013.01); *E04B 1/34326* (2013.01); *E04B 1/61* (2013.01); *E04B 1/7608* (2013.01)

(58) Field of Classification Search
CPC .... E04B 1/34321; E04B 1/34326; E04B 1/61; E04B 1/7608; E04B 1/08; E04B 1/14; E04B 1/2403; E04B 1/34342; E04B 1/34352; E04B 1/34384; E04B 1/3445; E04B 1/3483
USPC ..... 52/79.1, 79.5
See application file for complete search history.

(56) References Cited

U.S. PATENT DOCUMENTS 1,568,099 A * 1/1926 Strauss ..... E04B 1/34384 52/641
3,377,755 A * 4/1968 Meuli ..... E04B 1/06 52/223.6
3,470,660 A * 10/1969 Van Der Lely ..... E02D 27/01 52/471
3,707,811 A * 1/1973 Hampson ..... E04B 1/343 52/79.8
3,775,917 A * 12/1973 Struben ..... E04B 1/34342 52/169.12
3,878,658 A * 4/1975 Davis ..... B63B 25/16 220/592.25
3,992,829 A * 11/1976 Schellberg ..... E04B 1/34838 52/404.3
4,071,984 A * 2/1978 Larrow ..... E04C 2/284 52/309.4
4,475,327 A * 10/1984 O'Regan ..... E04H 5/10 52/579
4,545,158 A * 10/1985 Rizk ..... E04B 1/3483 52/309.8
4,546,530 A * 10/1985 Rizk ..... E04B 1/3483 29/430
4,546,578 A * 10/1985 Behrmann ..... E04B 1/344 52/79.5

(Continued)

OTHER PUBLICATIONS

Modular Homes—Screenshot from <https://www.modularhomes.com/> Modular Homes, Aug. 2023.

(Continued)

*Primary Examiner* — Brian D Mattei
*Assistant Examiner* — Joseph J. Sadlon

(57) ABSTRACT

An adaptive building system is provided. A wall system and rafter module are also provided.

7 Claims, 12 Drawing Sheets

(56) References Cited

U.S. PATENT DOCUMENTS 4,630,627 A * 12/1986 Windows ..... E04H 15/48 135/912
4,685,260 A * 8/1987 Jenn ..... E04H 1/02 D25/17
4,858,398 A * 8/1989 Ricchini ..... E04B 1/34315 52/584.1
4,875,310 A * 10/1989 Shaughnessy ..... E04B 1/34331 52/81.1
5,069,143 A * 12/1991 Bunger ..... B65D 19/0095 108/57.2
5,526,628 A * 6/1996 Knudson ..... E04B 7/022 52/537
5,596,844 A * 1/1997 Kalinowski ..... E04B 1/3442 52/79.5
5,735,639 A * 4/1998 Payne ..... B65D 90/0013 588/259
6,260,322 B1 * 7/2001 Lindsay ..... E04B 5/48 52/650.1
6,983,567 B2 * 1/2006 Ciotti ..... E04B 1/3442 52/79.5
7,178,297 B2 * 2/2007 Seavy ..... E04B 1/08 52/79.5
7,576,301 B2 * 8/2009 Gaskell ..... F24D 13/02 392/371
8,065,846 B2 * 11/2011 McDonald ..... E04B 5/10 52/262
8,166,715 B2 * 5/2012 De Azambuja ..... E04B 1/3444 52/79.5
8,621,798 B2 * 1/2014 Dayton ..... E04B 1/7629 52/309.1
8,881,470 B1 * 11/2014 Lass ..... E04B 1/3445 52/79.5
8,904,715 B2 * 12/2014 Preiss ..... E04C 2/296 52/582.1
9,085,890 B2 * 7/2015 Strickland ..... E04B 1/3442
9,151,053 B2 * 10/2015 Stephens, Jr. ..... E04B 1/7608
9,382,703 B2 * 7/2016 Quinn ..... E04B 1/02
9,388,561 B2 * 7/2016 Johnson ..... E04B 1/14
9,428,901 B2 * 8/2016 Price ..... E04C 2/46
9,458,621 B2 * 10/2016 Calafatis ..... E04B 1/34336
9,518,386 B2 * 12/2016 Ehsasi ..... E04B 1/2403
9,587,399 B2 * 3/2017 Jakobsen ..... E04B 1/7608
10,047,520 B2 * 8/2018 Morcrette ..... E04B 1/7629
10,480,179 B2 * 11/2019 Kennedy ..... E04B 2/58
10,544,587 B2 * 1/2020 Ibrahim ..... E04C 2/521
10,589,491 B2 * 3/2020 Gaudio ..... B32B 3/263
10,822,794 B2 * 11/2020 Ndobo-Epoy ..... E04C 2/246
11,105,088 B2 * 8/2021 Binder ..... E04C 3/07
11,155,990 B2 * 10/2021 Benard ..... E04B 1/388
11,192,332 B2 * 12/2021 Faotto ..... B32B 5/20
11,274,430 B2 * 3/2022 Scilley ..... E04B 1/34352
11,414,853 B2 * 8/2022 Boatwright ..... E04B 1/1912
11,619,041 B2 * 4/2023 Mullaney ..... E04B 1/34326 52/79.1
11,649,627 B2 * 5/2023 Heitsman ..... E04B 1/34838 52/79.1
11,697,935 B2 * 7/2023 Cullen ..... E04B 1/7612 52/717.02
11,851,877 B2 * 12/2023 Mort ..... E04B 1/7641
11,976,459 B2 * 5/2024 Hoddinott ..... E04B 1/34363
12,037,780 B2 * 7/2024 Kang ..... E04B 1/34861
12,116,771 B2 * 10/2024 Rafezy ..... E04B 1/3445
12,227,933 B2 * 2/2025 Koh ..... E04B 1/5831
2003/0024172 A1 * 2/2003 Lyons ..... A62C 3/16 52/267
2005/0044804 A1 * 3/2005 Bin ..... E04B 1/3445 52/79.5
2005/0155297 A1 * 7/2005 Aburto Ponce ..... E04B 1/161 52/79.1
2005/0284035 A1 * 12/2005 DeOvando ..... E04B 1/3431 52/79.1
2006/0048459 A1 * 3/2006 Moore ..... E04B 1/34321 52/79.1
2008/0134588 A1 * 6/2008 Knight ..... E04B 1/34815 52/79.5
2010/0018130 A1 * 1/2010 Lopez ..... E04B 1/3445 16/385
2011/0179741 A1 * 7/2011 Yen ..... E04B 1/34326 52/655.1
2011/0186100 A1 * 8/2011 Bolin ..... E04H 1/1205 264/41
2013/0171900 A1 * 7/2013 Bauer ..... B32B 5/16 428/688
2015/0292194 A1 * 10/2015 Calafatis ..... E04B 1/34321 52/67
2015/0292199 A1 * 10/2015 Federici ..... B32B 3/263 428/141
2017/0356181 A1 * 12/2017 Krause ..... E04B 1/388
2018/0163396 A1 * 6/2018 Boyles ..... B32B 27/28
2019/0010692 A1 * 1/2019 Segall ..... E04B 1/61
2019/0145116 A1 * 5/2019 Hartmann ..... E04B 1/34321 52/79.1
2020/0208399 A1 * 7/2020 Keller ..... E04B 7/024
2021/0172163 A1 * 6/2021 Sawada ..... E04C 2/422
2022/0145613 A1 * 5/2022 Haynes ..... B62D 27/02
2022/0349195 A1 * 11/2022 Rogers ..... E04H 1/1205
2022/0364354 A1 * 11/2022 Rafezy ..... E04B 1/3483
2023/0145279 A1 * 5/2023 Snorrason ..... E04B 1/34861 52/79.1
2023/0374770 A1 * 11/2023 Benavides ..... E04B 1/34321
2024/0044124 A1 * 2/2024 Bryant ..... E04B 1/02
2024/0191496 A1 * 6/2024 Timmons ..... E04B 1/3483
2024/0254753 A1 * 8/2024 Reddel ..... E04B 1/58
2025/0171997 A1 * 5/2025 Kolisnek ..... E04H 1/1205

OTHER PUBLICATIONS

Timberlyne—Screenshot from <https://www.timberlyne.com/?msclkid=c8f0f1ff34e416ef63ab95c771f2c279&utm_source=bing&utm_medium=cpc&utm_campaign=**LP%20-%20NonTM%20-%20Barns%20-%20General&utm_term=wood%20homes&utm_content=Barn%20Kits> Timberlyne Homes, Aug. 2023.
Our Siding Materials | Summerwood Products—Screenshot from <https://www.summerwood.com/information/siding> Summerwood Products, Jun. 2023.
DIY Home Building Kits—Screenshot from <https://www.shelter-kit.com/diy-home-kits> Shelter-Kit, last accessed Apr. 8, 2025.
SMALL & Midsize Cabin Kits—Screenshot from <https://allwoodoutlet.com/TINY-HOUSES-SMALL-AND-MIDSIZE-CABIN-KITS?page=2> Allwood Outlet, Mar. 2023.
Jamaica Cottage Shop Product Information Page—Screenshot from <https://jamaicacottageshop.com/product-information/> Jamaica Cottage Shop, Jun. 2023.
360° Design Studio—Screenshot from <https://deltechomes.com/360-design-studio/> Deltec Homes, last accessed Apr. 8, 2025.

* cited by examiner

ADAPTIVE BUILDING SYSTEM AND PARTS

CROSS-REFERENCE TO RELATED APPLICATION

This application claims priority to U.S. Provisional Application No. 63/607,866, filed Dec. 8, 2023, which is herein incorporated by reference in its entirety.

FIELD OF THE INVENTION

The field of the subject matter is an adaptive building system for, for example, human occupancy or storage. For example, in some embodiments, the invention relates to a modular, expandable and changeable building system for housing of humans or animals, office space and/or storage.

BACKGROUND OF THE INVENTION

Prefabricated buildings, including houses and storage buildings, are currently available today. Prefabricated houses are typically constructed at a manufacturing site and then transported and assembled at a building site. These house are typically designed and constructed in a variety of floor plans. These plans, however, are only minimally adaptable by the customer.

Another form of prefabricated houses are manufactured homes, which can also be known as a double wide. The layout of a double wide is typically restricted to the prebuild design and cannot be adapted by the customer. Still another type of prefabricated house is panelized constructions. Panelized construction is where house panels are finished in a factory and transported to a building site. Similar products are available for storage buildings.

There is a need for an adaptive building system. For example, there is a need for housing, office space and/or storage space which can be adapted to a customer selected layout either at the time of the original build or at a later time.

SUMMARY OF THE INVENTION

These and other needs are addressed by the various aspects, embodiments, and configurations of the present disclosure.

In Example 1, a building module system includes a building module, which includes a base support, a plurality of wall panels and siding panels. The base support includes a frame, a subfloor, floor supports, a first bottom wing, a second bottom wing, flooring panels, a roof support ceiling panels, a first top wing, a second top wing and vertical supports. The frame has a first side, a second side, a first end and a second end. The subfloor is connected to the frame and extends from the first side to the second side and from the first end to the second end. The floor supports are positioned above the subfloor, and each floor support extends from the first side to the second side of the frame. The first bottom wing is connected to and extends upwards from the first side of the frame. The second bottom wing is connected to and extends upwards from the second side of the frame. The flooring panels are positioned above and are supported by the floor supports. Each floor panel extends from the first side to the second side of the frame and the flooring panels together extend from the first end to the second end of the frame. The roof support is spaced apart from the base support and has a first side, a second side, a first end and a second end. The ceiling panels are attached to the roof support. The first top wing is connected to and extends downward from the first side of the roof support. The second top wing is connected to and extends downward from the second side of the roof support. The vertical supports extend vertically between the base support and the roof support. The plurality of wall panels are connected to the frame and extend from the flooring panels to the ceiling panels, the ceiling panels, floor panels and wall panels creating an interior space of the building module. The siding panels are attached to and extend from the first top wing to the first bottom wing and from the second top wing to the second bottom wing. The siding panels create an exterior surface of the building module.

In Example 2, the building module system of Example 1 wherein the wall panels include at least a first wall panel and a second wall panel and each of the first wall panel and the second wall panel include an interior panel having a top interior panel edge, a bottom interior panel edge, a first side interior panel edge and a second side interior panel edge; a first insulating panel connected to the interior panel, the first insulating panel having a top first insulating panel edge aligned with the top interior panel edge, a bottom first insulating panel edge aligned with the bottom interior panel edge, a first side first insulating panel edge aligned with the first side interior panel edge and a second side first insulating panel edge aligned with the second side interior panel edge; and a second insulating panel connected to the first insulating panel, the second insulating panel having a top second insulating panel edge aligned with the top first insulating panel edge, a bottom second insulating panel edge aligned with the bottom interior panel edge, a first side second insulating panel edge not aligned with the first side first insulating panel edge and forming a protrusion, and a second side second insulating panel edge not aligned with the second side first insulating panel edge and forming a notch, wherein the protrusion of the first wall panel fits within the notch of the second wall panel and a portion of the first wall panel overlaps with a portion of the second wall panel.

In Example 3, the building module system of Example 2 wherein the protrusion of the first wall panel fits within the notch of the second wall panel and a portion of the first wall panel overlaps with a portion of the second wall panel.

In Example 4, the building module system of Example 3 and further including a panel connecting support connected to the second insulating panel of the first wall panel and the second insulating panel of the second wall panel.

In Example 5, the building module system of Example 2 wherein the first wall panel and the second wall panel are removable in whole.

In Example 6, the building module system of Example 2 wherein a window or a door is positioned within the first wall panel and is in communication with the interior panel, the first insulating panel and the second insulating panel.

In Example 7, the building module system of Example 1 and further comprising a rafter module connected to the roof support. The rafter module includes a plurality of webs spaced apart from one another and extending in a first direction, the webs having a top surface, a bottom surface, a first end and a second end; a plurality of chords spaced apart from one another and extending in a second direction perpendicular to the first direction, the plurality of chords connected to the top surface of the webs; and a bottom chord connected to the bottom surface of the webs at the second end, the bottom chord creating a slope so that the second ends of the webs are higher than the first ends of the webs.

In Example 8, the building module system of Example 7 and further comprising a plurality of rafter modules connected to one another.

In Example 9, the building module system of Example 1 and further including a second building module connected to the building module.

In Example 10, a method of building a building module for human occupancy, the method including building a base support, connecting a plurality of wall panels to the frame, and connecting a plurality of siding panels to and extending from the first top wing to the first bottom wing and from the second top wing to the second bottom wing, the siding panels creating an exterior surface of the building module. The base support includes a frame having a first side, a second side, a first end and a second end; a subfloor connected to the frame and extending from the first side to the second side and from the first end to the second end; floor supports positioned above the subfloor, each floor support extending from the first side to the second side of the frame; a first bottom wing connected to and extending upwards from the first side of the frame; a second bottom wing connected to and extending upwards from the second side of the frame; flooring panels positioned above and supported by the floor supports, each floor panel extend from the first side to the second side of the frame and the flooring panels together extending from the first end to the second end of the frame; a roof support spaced apart from the base support and having a first side, a second side, a first end and a second end; ceiling panels attached to the roof support; a first top wing connected to and extending downward from the first side of the roof support; a second top wing connected to and extending downward from the second side of the roof support; and vertical supports extending vertically between the base support and the roof support. The wall panels extend from the flooring panels to the ceiling panels. The ceiling panels, floor panels and wall panels creating an interior space of the building module.

In Example 11, the method of Example 10, wherein all lumber used is standard size lumber.

In Example 12, the method of Example 10, wherein each wall panel can be removed as a single unit.

In Example 13, the method of Example 10, wherein each flooring panel can be removed as a single unit.

In Example 14, the method of Example 10 and further comprising connecting the base support to a second base support.

In Example 15, the method of Example 10 wherein building the base support is accomplished without cutting lumber.

In Example 16, the method of Example 10 wherein the wall panels include at least a first wall panel and a second wall panel, and each of the first wall panel and the second wall panel include: an interior panel having a top interior panel edge, a bottom interior panel edge, a first side interior panel edge and a second side interior panel edge; a first insulating panel connected to the interior panel, the first insulating panel have a top first insulating panel edge aligned with the top interior panel edge, a bottom first insulating panel edge aligned with the bottom interior panel edge, a first side first insulating panel edge aligned with the first side interior panel edge and a second side first insulating panel edge aligned with the second side interior panel edge; and a second insulating panel connected to the first insulating panel, the second insulating panel having a top second insulating panel edge aligned with the top first insulating panel edge, a bottom second insulating panel edge aligned with the bottom interior panel edge, a first side second insulating panel edge not aligned with the first side first insulating panel edge and forming a protrusion, and a second side second insulating panel edge not aligned with the second side first insulating panel edge and forming a notch, wherein the protrusion of the first wall panel fits within the notch of the second wall panel and a portion of the first wall panel overlaps with a portion of the second wall panel.

In Example 17, the method of Example 16 and further including removing the first wall panel to form an opening; and connecting the base support to a second base support at the opening.

In Example 18, the method of Example 16 and further comprising repairing the first wall panel by disconnecting the first wall panel from the second wall panel, removing the first wall panel from the frame, repairing the first wall panel and reconnecting the first wall panel to the frame.

In Example 19, the method of Example 10 and further including connecting a rafter module to the roof support. The rafter module including a plurality of webs spaced apart from one another and extending in a first direction, the webs having a top surface, a bottom surface, a first end and a second end; a plurality of chords spaced apart from one another and extending in a second direction perpendicular to the first direction, the plurality of chords connected to the top surface of the webs; and a bottom chord connected to the bottom surface of the webs at the second end, the bottom chord creating a slope so that the second ends of the webs are higher than the first ends of the webs.

In Example 20, An adaptive wall system for a building module, the adaptive wall system including a first wall panel and a second wall panel. Each of the first wall panel and the second wall panel having: an interior panel having a top interior panel edge, a bottom interior panel edge, a first side interior panel edge and a second side interior panel edge; a first insulating panel have a top first insulating panel edge aligned with the top interior panel edge, a bottom first insulating panel edge aligned with the bottom interior panel edge, a first side first insulating panel edge aligned with the first side interior panel edge and a second side first insulating panel edge aligned with the second side interior panel edge; and a second insulating panel having a top second insulating panel edge aligned with the top first insulating panel edge, a bottom second insulating panel edge aligned with the bottom interior panel edge, a first side second insulating panel edge not aligned with the first side first insulating panel edge and forming a protrusion, and a second side second insulating panel edge not aligned with the second side first insulating panel edge and forming a notch, wherein the protrusion of the first wall panel fits within the notch of the second wall panel and a portion of the first wall panel overlaps with a portion of the second wall panel.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. The drawings may not be to scale. Further features and advantages will become apparent from the following, more detailed, description of the various aspects, embodiments, and configurations of the disclosure, as illustrated by the drawings referenced below.

DETAILED DESCRIPTION

The present disclosure provides a new adaptive and changeable building module system which allows pieces of a building to be moved or relocated with ease either at the time of the original build or at a later time. The present system can be used to construct housing buildings, office buildings and storage buildings. The building modular system is comprised of one or more modular units which can be configured in a variety of orientations, allowing unique floorplans and layouts such as L-shaped, squares with an inner court yard and long rectangular shapes, just to name a few. The adaptive building system can be constructed with building materials available at common retail or home improvement stores, removing the need for a customer to purchase specialty parts from a specific retailer or cut lumber.

Figure 1:
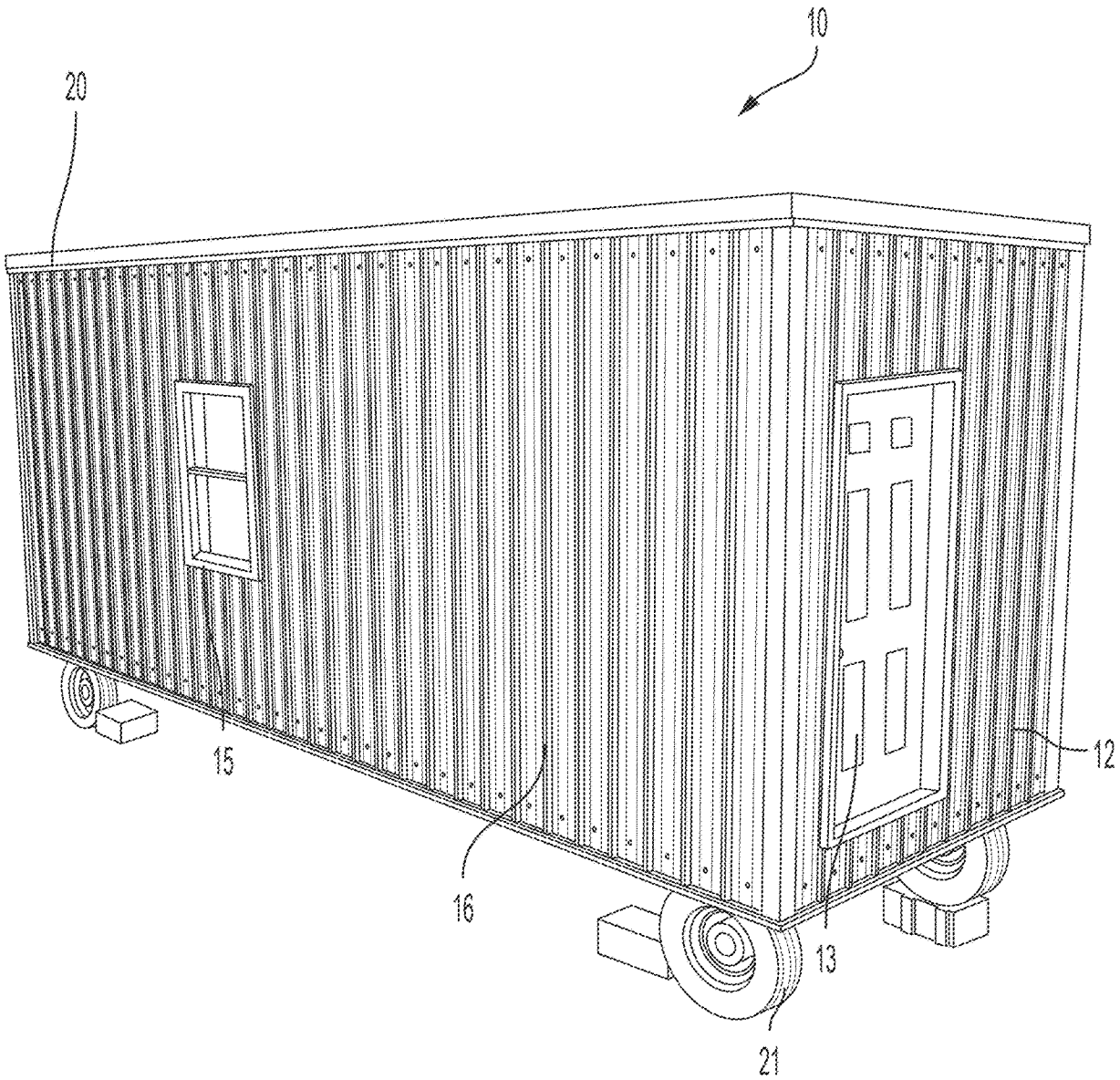
FIG. 1 is a photograph of an exemplary building module.

FIG. 1 is a photograph of exemplary building module 10 which includes first end wall 12, first side wall 16 and roof 20 which together with second end wall 14, second side wall 18 and flooring panels 71 (See FIG. 2) form an enclosed structure. Building module 10 can include one or more doors 13, which can be positioned within one of the walls, such as first end wall 12. Building module 10 can also include one or more windows 15, which can be positioned within one of the walls, such as first side wall 16. Building module 10 can be attached to a carriage which includes wheels 21. Wheels 21 allow building module 10 to be moved.

Figure 2:
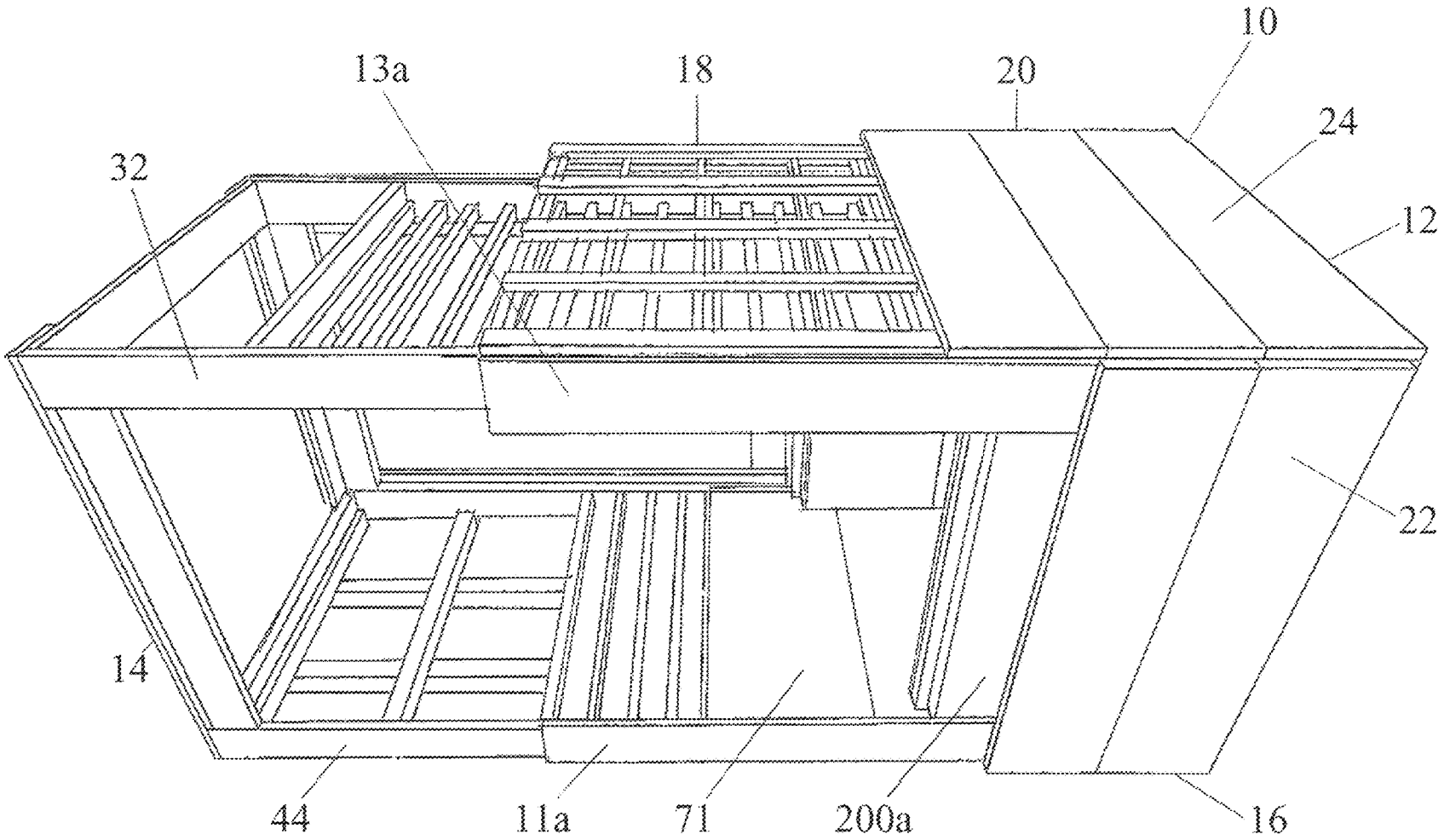
FIG. 2 is a perspective view of a building module.

FIG. 2 is a perspective view of building module 10 in which portions of building module 10 have been removed to show detail inside the structure. Building module 10 includes first end wall 12, second end wall 14, first side wall 16, second side wall 18 and roof 20. First end wall 12 and second end wall 14 are opposite each other and form two of the four walls of building module 10. First end wall 12 and second end wall 14 are the same shape and size. First side wall 16 and second side wall 18 are also opposite each other and form the other two walls of building module 10. First side wall 16 and second side wall 18 are the same shape and size. Roof 20 is attached to the top of first end wall 12, second end wall 14, first side wall 16, second side wall 18 and roof 20 and together these components create an enclosed rectangular living space.

In some embodiments, siding 22, such as steel siding or steel paneling, can be attached to the outside of first end wall 12, second end wall 14, first side wall 16 and second side wall 18 to provide an exterior surface and protection of the living space from the outdoor elements. Siding 22 is designed to allow adjustment. In some embodiments, roof 20 can include covering 24 to protect the top of building module 10 from the outdoor elements. Suitable coverings include steel sheets or shingles, such as asphalt shingles. As discussed herein, first end wall 12, second end wall 14, first side wall 16 and/or second side wall 18 can include various additional elements, such as doors and/or windows. In some embodiments, building module 10 has outer dimensions of about 8 feet in width and 24 feet long and has about 8 foot high ceilings inside. As explained herein, these dimensions are obtained by using commonly commercially available materials and little to no additional cutting of lumber is required for assembly.

Figure 3:
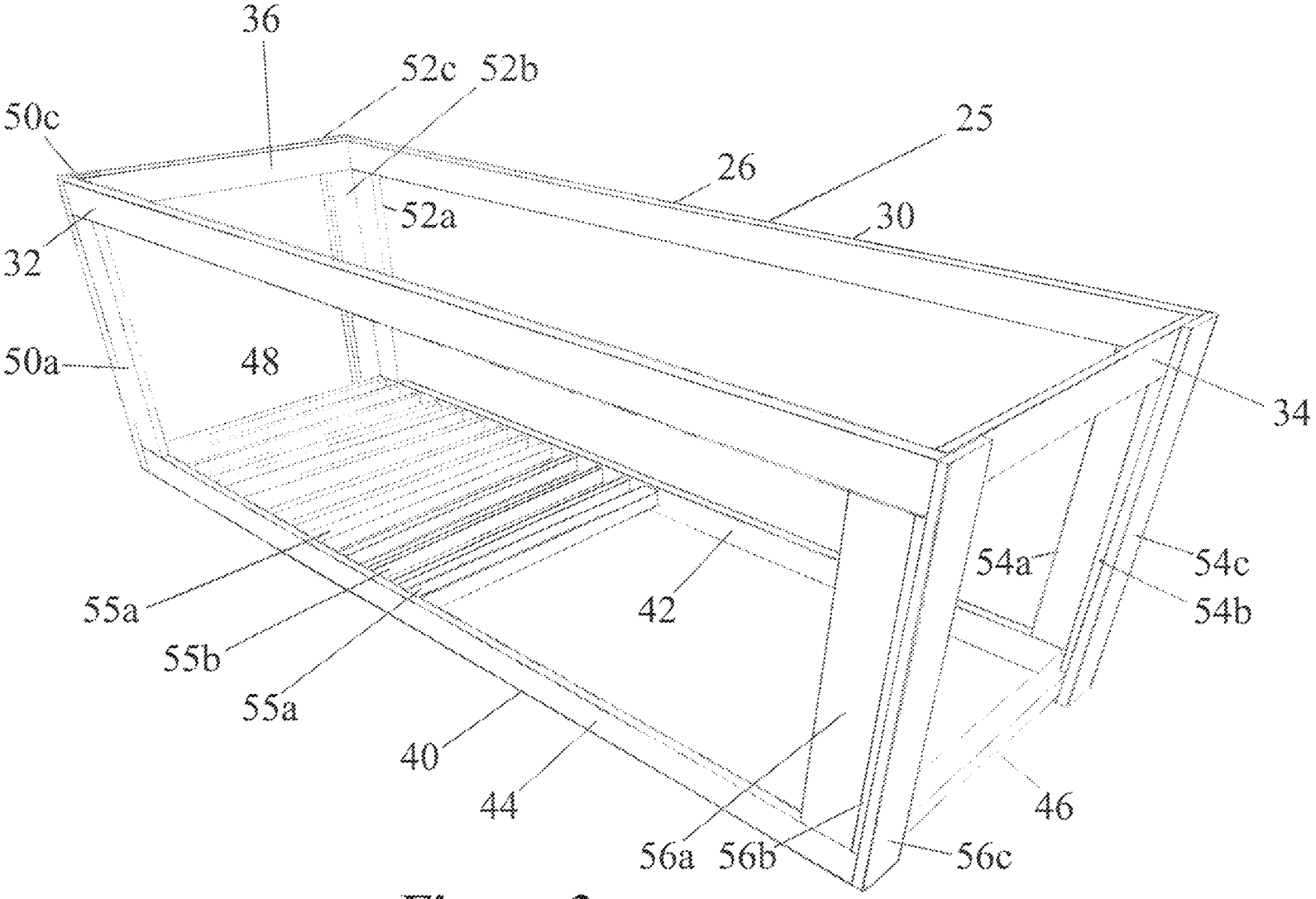
FIG. 3 is a perspective view of a frame support.
Figure 7:
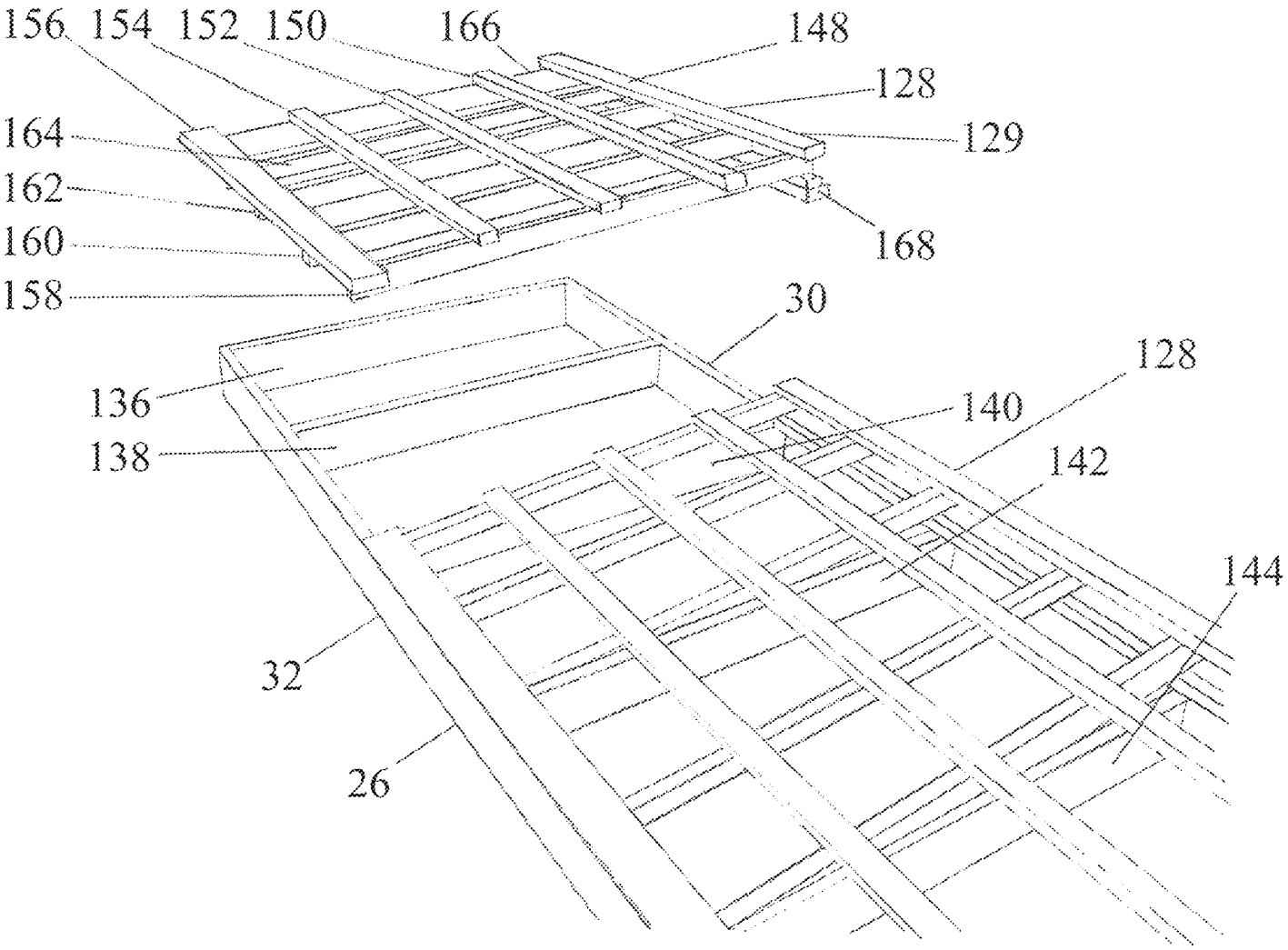
FIG. 7 is an exploded view of a roof.

FIG. 3 is a perspective view of frame support 25 which includes roof support 26 (having lengthwise roof supports 30 and 32 and cross supports 34 and 36), base support 40 (having lengthwise base supports 42 and 44 and cross supports 46 and 48), vertical supports 50*a*, 50*b*, 52*a*, 52*b*, 54*a*, 54*b*, 56*a* and 56*b*, vertical panels 50*c*, 52*c*, 54*c* and 56*c* and floor supports 55*a* and 55*b*. Roof support 26 includes lengthwise roof supports 30 and 32 which run the length of building module 10 and cross supports 136, 138, 140, 142, 144 (shown in FIG. 7) which extend perpendicular to lengthwise roof supports 30 and 32. In some embodiments, lengthwise roof supports 30 and 32 are 2×12 boards available from a commercial lumber yard which are 24 feet in length. That is, lengthwise roof supports can be about 24 feet in length, 12 inches wide and 1.5 inches thick.

Cross supports 34 and 36 attach to the ends of lengthwise roof supports 30 and 32. In some embodiments, cross supports 34 and 36 connect to lengthwise roof supports 30 and 32 at basic butt joints and lengthwise roof supports 30 and 32 cover the ends of cross supports 34 and 36.

Base support 40 includes lengthwise base supports 42 and 44 which run the length of building module 10 and cross supports 46 and 48 which extend perpendicular to lengthwise base supports 42 and 44 In some embodiments, lengthwise base supports 42 and 44 are 2×12 boards available from a commercial lumber yard which are 24 feet in length. That is, lengthwise base supports can be about 24 feet in length, 12 inches wide and 1.5 inches thick. In some embodiments, cross supports 46 and 48 can be 6×6 boards that are 8 feet in the length.

Cross supports 46 and 48 attach to the ends of lengthwise base supports 42 and 44. In some embodiments cross supports 46 and 48 connect to lengthwise base supports 42 and 44 at basic butt joints and lengthwise base supports 42 and 44 cover the ends of cross supports 46 and 48.

Vertical supports 50*a*, 50*b*, 52*a*, 52*b*, 54*a*, 54*b*, 56*a* and 56*b* form the corners of frame support 25 and connect base support 40 and roof support 26. Vertical supports 50*a*, 50*b*, 52*a*, 52*b*, 54*a*, 54*b*, 56*a* and 56*b* extend upwards from the corners of base support 40. Vertical supports 50*a* and 50*b* form a first corner, vertical supports 52*a* and 52*b* form a second corner, vertical supports 54*a* and 54*b* form a third corner and vertical supports 56*a* and 56*b* form a fourth corner. In some embodiments, vertical supports 50*a*, 50*b*, 52*a*, 52*b*, 54*a*, 54*b*, 56*a* and 56*b* can be 8 feet in length. Vertical supports 50*a*, 50*b*, 52*a*, 52*b*, 54*a*, 54*b*, 56*a* and 56*b* transfer weight from roof support 26 to base support 40. Additional vertical supports may be added to increase roof support or even stacking of multiple building modules.

Vertical panels 50*c*, 52*c*, 54*c* and 56*c* are positioned over vertical supports 50*b*, 52*b*, 54*b* and 56*b*. One end of vertical panel 54*c* is flush with the edge of cross support 34 and the opposite end of vertical panel 54*c* is flush with the edge of cross support 46. Vertical panels 50*c*, 52*c*, 54*c* and 56*c* connect roof support 26 to base support 40 and helps prevent sideways movement. In one embodiment, vertical panels 50*c*, 52*c*, 54*c* and 56*c* can be 10 feet in length so they extend from the top edge to the bottom edge of building module 10.

Floor supports 55*a* and 55*b* extend between lengthwise base supports 42 and 44. Floor supports 55*a* can be 4×6 boards and floor supports 55*b* can be 2×6 boards. Floor supports 55*a* and 55*b* can be arranged in a pattern such that floor supports 55*a* are positioned every 4 four feet and floor supports 55*b* are positioned every foot between adjacent floor supports 55*a*. In this way, three floor supports 55*b* are positioned between adjacent floor supports 55*a*.

Figure 4:
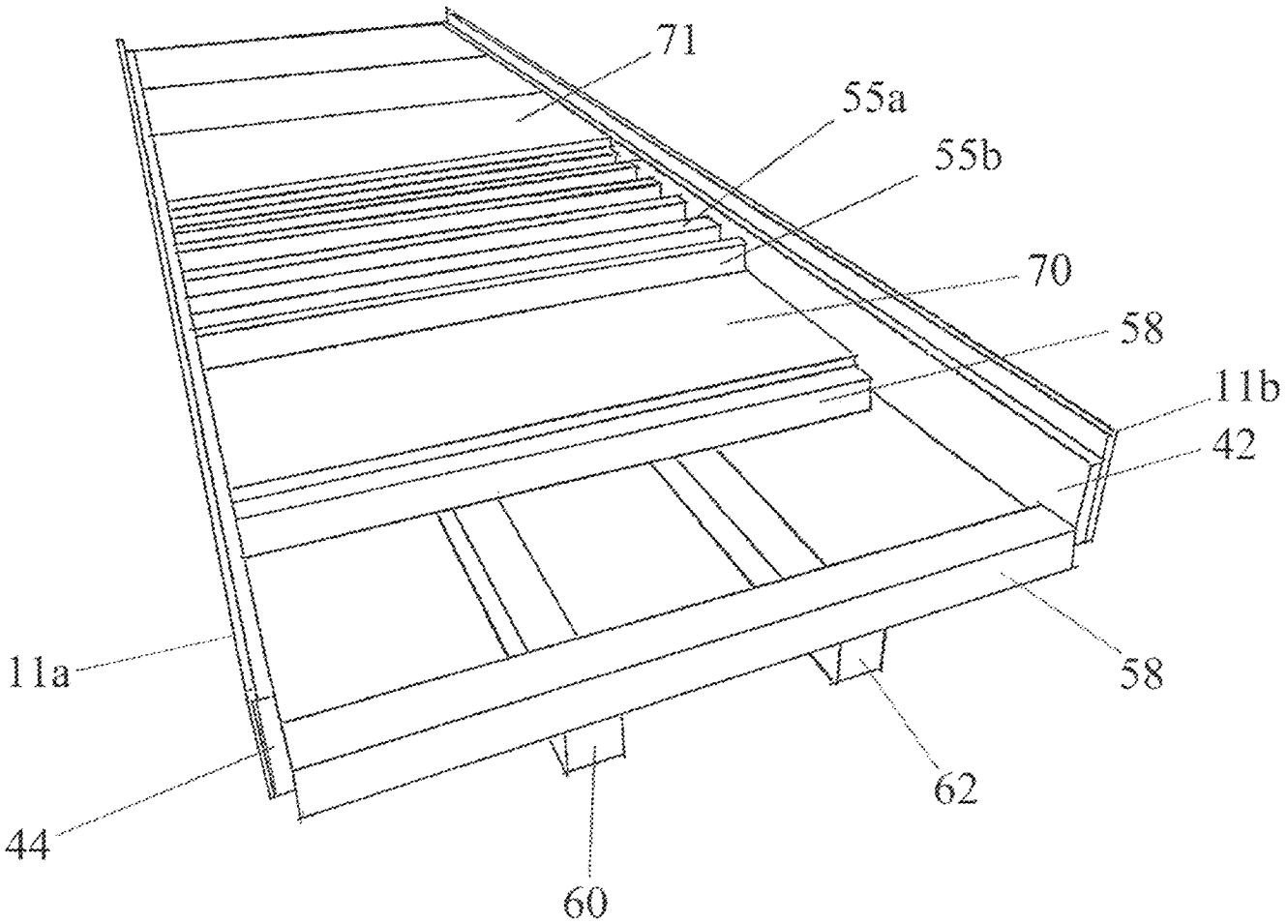
FIG. 4 is a perspective view of the frame support of FIG. 2 and including a flooring module.

FIG. 4 is a perspective view of the base or flooring structure and including optional carriage 72. Carriage 72 attaches to base support 40 and allows for building module 10 to be attached to a trailer, wheels or other running gear. Carriage 72 also provides additional space for utilities to run under building module 10.

Figure 5:
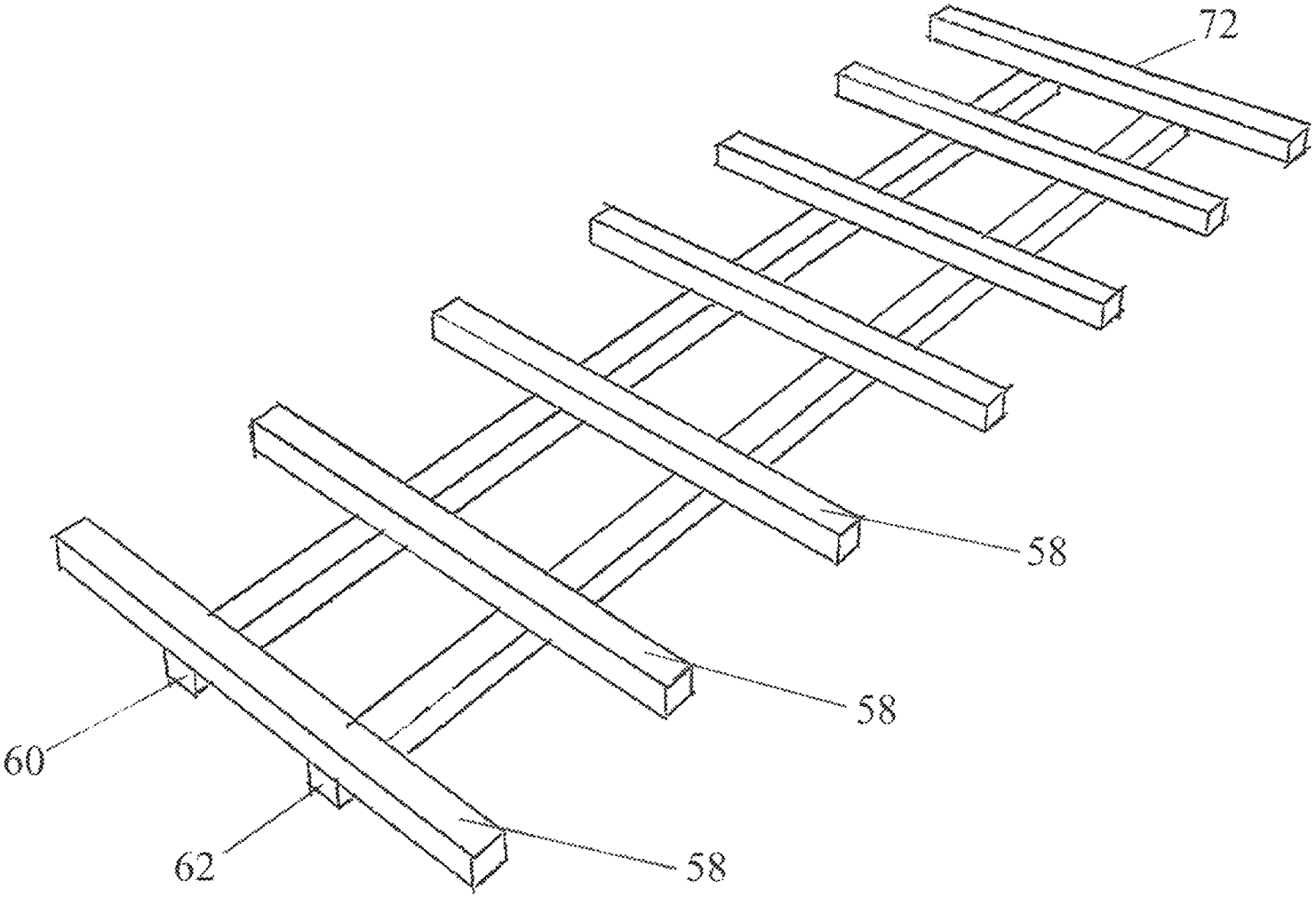
FIG. 5 is an enlarged perspective view of a floor frame support.

FIG. 5 is an enlarged perspective view of carriage 72, which includes carriage supports 58 and lengthwise supports 60 and 62. In some embodiments, lengthwise supports 60 and 62 can be spaced about 42 inches apart and can be 6×6 boards that are 24 feet in length. Lengthwise supports 60 and 62 extend between cross support 46 and 48 of base support 40. Carriage supports 58 are perpendicular to lengthwise supports 60 and 62 and extend between lengthwise base supports 42 and 44. Carriage supports can be 6×6 boards and can be positioned 4 feet apart along the length of building module 10. In some embodiments, carriage 72 can be built first and building module 10 can be built onto existing carriage 72. In other embodiments, carriage 72 can be added to an existing building module 10. In this way, building module 10 can be adapted even after it is built.

The flooring structure is further shown in FIG. 4. Subfloor 70 is positioned on top of carriage supports 58. In some embodiments, subfloor 70 can be plywood or other flat material. In some embodiments, subfloor 70 can be about half an inch thick. Next, floor supports 55*a* and 55*b* are positioned on top of subfloor 70. Finally, flooring panels 71 are positioned on top of floor supports 55*a* and 55*b*. In some embodiments, subfloor 70 can be plywood, such as ¾ inch thick plywood. Insulation can be positioned between subfloor 70 and flooring panels 71. For example, insulation can be blown in between subfloor 70 and flooring panels 71. This structure allows the floor to be accessed from inside building module 10 and/or from underneath building module 10.

In use, if carriage 72 is present, carriage 72 can sit on a foundation, such as concrete blocks, or a platform or slab. If carriage 72 is not present, base 40 can sit on a foundation, such as concrete blocks, or a platform or slab. In some embodiments, additional insulation can be added to carriage 72. In other embodiments, insulation can be connected to the underside of the subfloor with or without the use of carriage 72.

Figure 6:
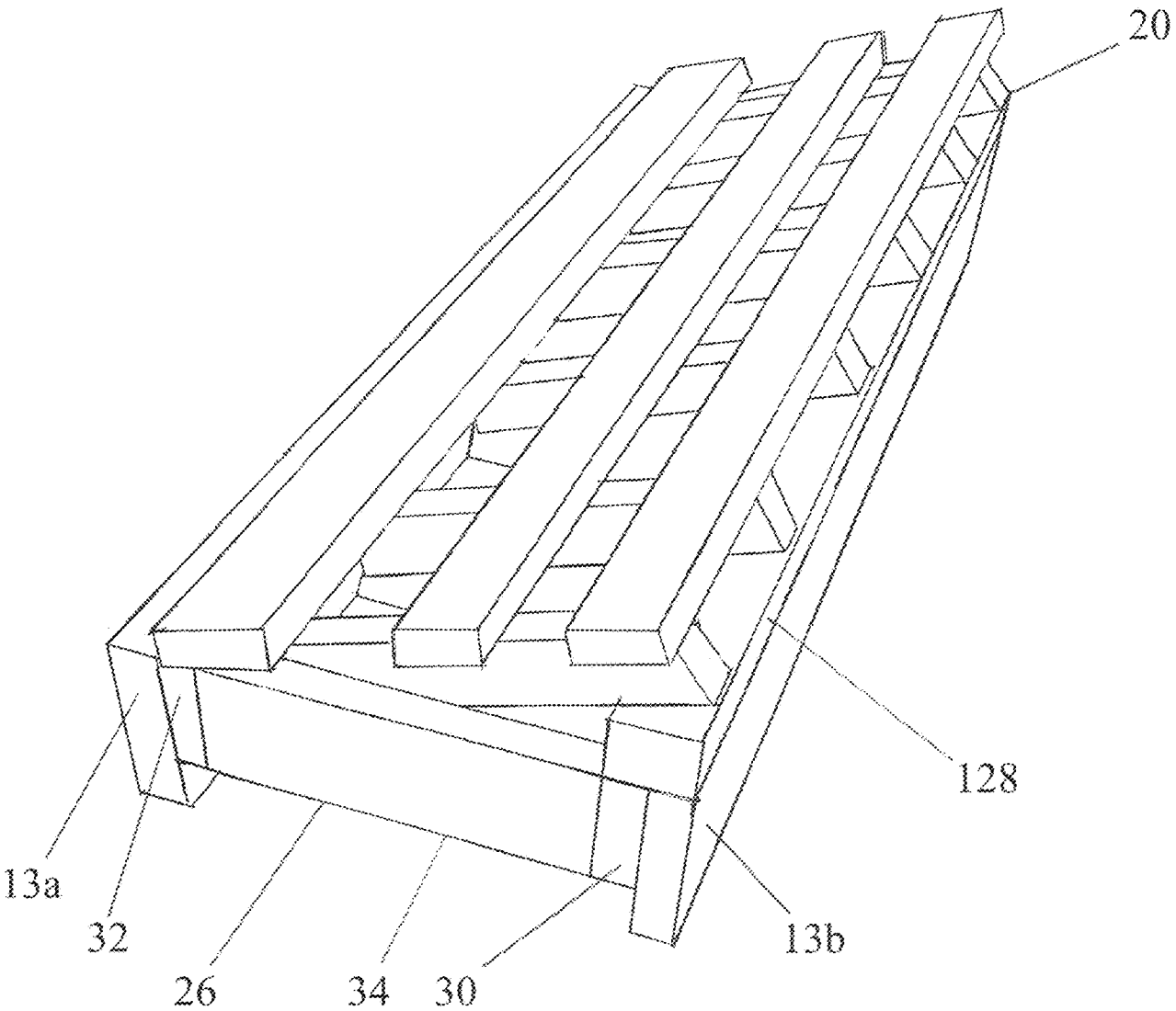
FIG. 6 is a perspective view of a roof.

FIG. 6 is a perspective view of a portion of roof 20 with siding 22 and covering 24 removed to show roof support 26 and rafter 128. Roof support 26 supports rafter 128 and connects rafter 128 to the remainder of building module 10. Additional cross supports 138-144 can be positioned between lengthwise roof supports 30 and 32 as shown in exploded view FIG. 7. In some embodiments, cross supports 134-144 can be 2×4 boards and 2×12 boards. For example, 2×4 boards can be positioned every 1 foot between 2×12 boards. And 2×12 boards can be positioned every 4 feet. In this way, a trough is formed between adjacent 2×12 boards while support is given by the 2×4 boards to the overhead structure.

Rafter 128 is formed from one or more rafter modules 129, which are formed by top chords, such as first top chord 148, second top chord 150, third top chord 152, fourth top chord 154 and fifth top chord 156, webs, such as webs 158-166, and bottom chord 168. Top chords 148-156 run the length of building module 10. In some embodiments, top chords 148-156 can be about 8 feet in length. In some embodiments, top chords 148-154 can be 2×4 boards available from a lumber yard which are 8 feet in length. Top chord 156 may be the same width as or wider than the boards used for top chords 148-152. For example, top chord 156 can be a 2×4 board or a 2×6 board available from a lumber yard which is 8 feet in length. Top chord 156 may not be flush with the ends of webs 166-158. For example, top chord 156 may extend about 2 inches past the ends of webs 166-158. In some embodiments, top chords 148-156 are not flush with sides of webs 158 and 166 and can hang over the side of web 158 and web 166 by ¾-1.5 inches. In some embodiments, top chord 156 can also hang over the ends of webs 158-164 and can be connected to roof support 32. For example, top chord 156 can overhang the ends of each of webs 158-162 by about ¾ inch to about 1.5 inches. In some embodiments, every four feet webs 158-162 can be attached to cross supports 136 and 138. For example, in FIG. 7, webs are attached to cross supports 140, 142 and 144. This can provide further stability and attachment of roof 20.

Each of webs 158-166 span the width of building module 10 and between top chords 148-156. Top chords 148-156 are attached to webs 158-166 for example with screws or nails. Webs 158-166 are spaced apart from one another. For example, in some embodiments, a web can be positioned along the length of top chords 148-156. Webs 158-166 can be 2×4 boards which are turned such that the narrower side is in contact with the top chords. In some embodiments, an first end of web 158 is aligned with the outer edge of top chord 156 and the second end of web 158 is aligned with the outer edge of top chord 148.

Top chords 148-156 are spaced apart from one another. In some embodiments, a top chord can be positioned along the length of a web. In some embodiments, a first end of a chord, such as first top chord 148 is aligned with an outer edge of web 158 and a second end of chord 148 is aligned with the outer edge of web 166. The remaining webs and top chords may be aligned in a similar manner. In some embodiments, the top surface of the web is in connect with the top chord. For example, the top surface of webs 158-164 are in contact with the bottom surface of top chords 148-156.

Bottom chord 168 is attached to lengthwise roof support 30 and to the second ends of webs 158-166. Bottom chord 168 elevates the second ends of webs 158-166 to create a sloped rafter 128. For example, the thickness of bottom chord 168 may be selected such that rafter 128 has a 12×1 slope. Bottom chord 168 can be formed from one or more 2×4 boards. If more than one more is used, the boards are stack on top of one another to form thickness of bottom chord 168 and the distance between second ends of webs 158-166 and lengthwise roof support 30. In some embodiments, bottom chord 168 is the same length as top chord 148. The bottom chord 168 is in contact with the bottom surface of the webs. For example, the top surface of bottom chord 168 is in contact with the bottom surface of webs 158-164.

Rafter 128 may include one or more rafter modules 129 depending on the length of rafter 128. Rafter modules 129 are positioned adjacent to one another on roof support 26 such that rafter modules 129 extend the length of roof support 26. Top chord 156 can be connected to lengthwise roof support 32 for example by screws or nails and bottom chord 68 can be connected to lengthwise roof support 30 for example by screws or nails. A roof covering material, such as steel sheeting, can be attached to top chords 148-156 to protect rafters 128 and create an enclosed building module 10.

Plywood or other flat surface can be attached to the bottom of rafter 128 to form the ceiling in building module 10. For example, plywood can be positioned to form ceiling panels on the bottom of rafters 128. In some embodiments, insulation can be positioned in the rafters 128 and the plywood keeps the insulation in place.

Roof 20 is formed from supplies readily available at a lumber or hardware store, which simplifies the construction and reduces costs. Roof 20 can be quickly constructed and attached to building module 10. Additionally, roof 20 is designed to allow the user to change the configuration of multiple building module 10. For example roof 20 allows multiple building modules 10 to be arranged end to end to form a long rectangle configuration (see FIG. 12), an L-shaped building, an U-shaped building or a square building with an inner courtyard.

Roof 20 can be formed using one or more rafters 128. In some embodiments, each rafter 128 can be built and then installed as a single unit. Additionally, each rafter 128 can be removed as a single unit. That is, rafter 128 can be removed in whole. For example, if a building module included three rafters and the middle rafter was damaged, the middle rafter could be removed as a single unit leaving the rafters on either side in place. The middle rafter could then be repaired and set back into place. If the rafter could not be repaired, a new rafter could be positioned in its place.

Figure 9:
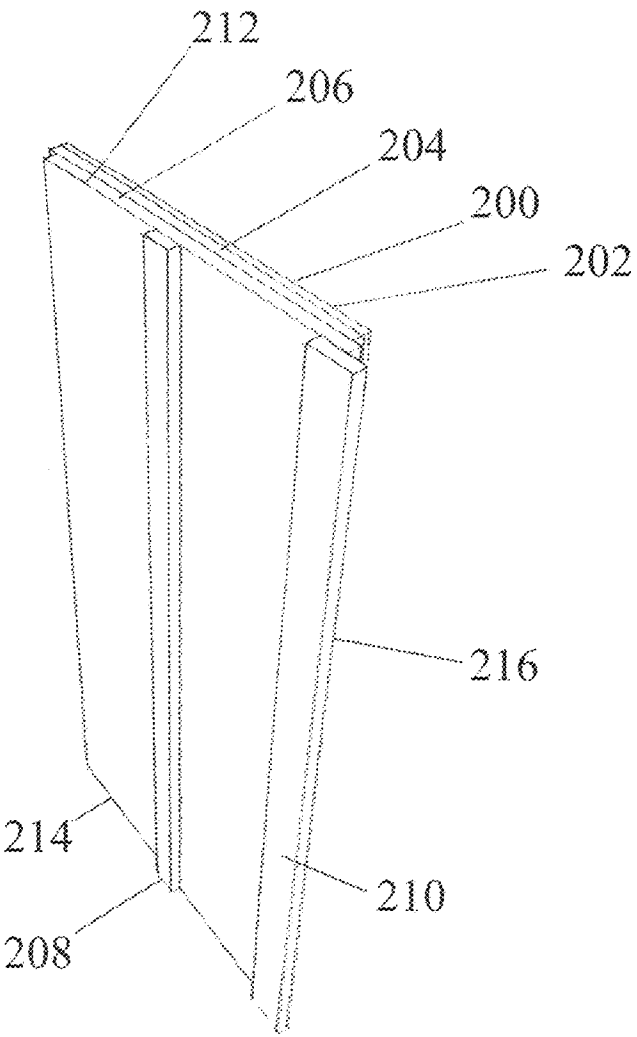
FIG. 9 is a back view of the wall panel of FIG. 7.
Figure 8:
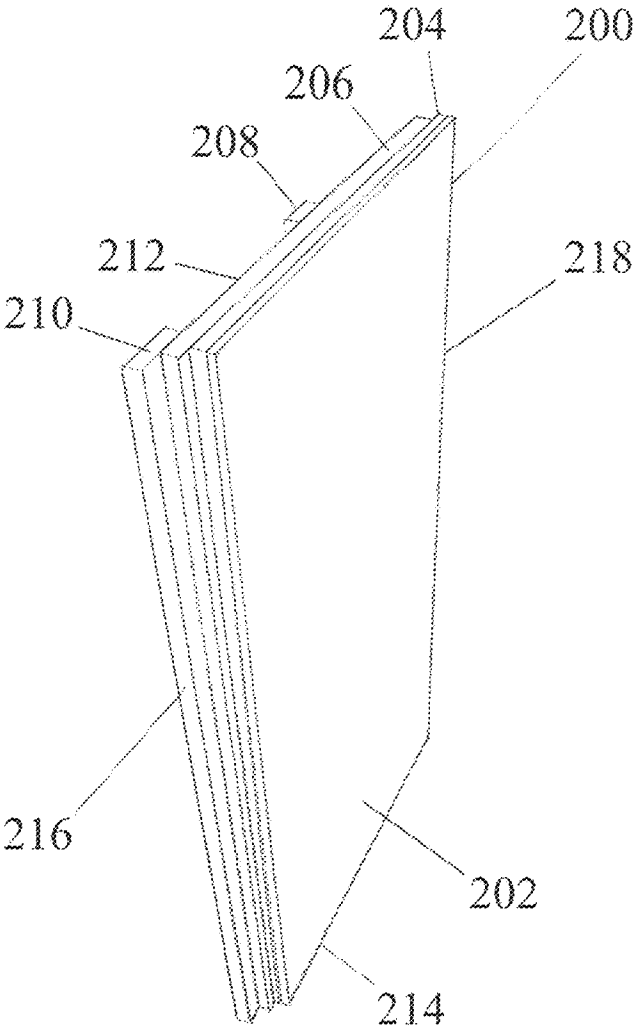
FIG. 8 is a front view of a wall panel.

FIG. 8 is a front view and FIG. 9 is a back view of wall panel 200, which includes interior panel 202, first insultation panel 204, second insulation panel 206, panel support 208 and panel connecting support 210. Interior panel 202, first insulation panel 204 and second insulation panel 206 have the same height (measured from top edge 212 to bottom edge 214) and width (measured from first side edge 216 to second side edge 218). Interior panel 202, first insulation panel 204 and second insulation panel 206 form a sandwich construction.

Interior panel 202 faces into building module 10. In some embodiments, interior panel 202 is a finished surface and is the exposed wall surface on the inside of building module 10. In other embodiments, interior panel 202 can be further finished or painted. Interior panel 202 can be a wood laminate or plywood.

First insulation panel 204 is directly adjacent to interior panel 202. First insulation panel 204 and interior panel 202 are aligned along top edge 212, bottom edge 214, first side edge 216 and second side edge 218. First insulation panel 204 provides insulation to building module 10. In some embodiments, first insulation panel 204 is a closed-cell extruded polystyrene foam (XPS), such as Styrofoam™, panel. The thickness of insulation panel 204 can vary depending, for example, on the amount of insulation desired. In some embodiments, first insulation panel 204 is about 1.5 inches thick.

Second insultation panel 206 aligns with first insultation panel 204 at top edge 212 and bottom edge 214 of wall panel 202. Second insulation panel 206 does not align with first insulation panel 204 at first side edge 216 or second side edge 218 such that second insultation panel 206 is offset from first insulation panel 204. For example, the offset can form a notch or step at one side of wall panel 202 and a protrusion or step at the other side of wall panel 202. Second insulation panel 206 can be a XPS panel. The thickness of insulation panel 206 can vary depending, for example, on the amount of insulation desired. In some embodiments, first insulation panel 204 is about 1.5 inches thick. While two insulation panels are show in FIG. 8 and FIG. 9, in some embodiments, wall panel 200 can contain more than two insulation panels.

Panel support 208 provides support to wall panel 200. In some embodiments, panel support 208 is 2×4 board.

Panel connecting support 210 also extends from top edge 212 to bottom edge 214 and provides support to wall panel 200. Additionally, panel connecting support 210 extends from first side edge 216 and can be used to connect two adjacent wall panels 200. For example the portion of panel connecting support 210 which extends from first side edge 216 can overlap onto an adjacent wall panel and thus can be connected to an adjacent wall panel using fasteners such as screws or nails. In some embodiments, panel connecting support 210 is a 2×4 or 2×6 board. The boards can vary in size. For example, thicker boards can be used to provide more room to run utilities.

Figure 10:
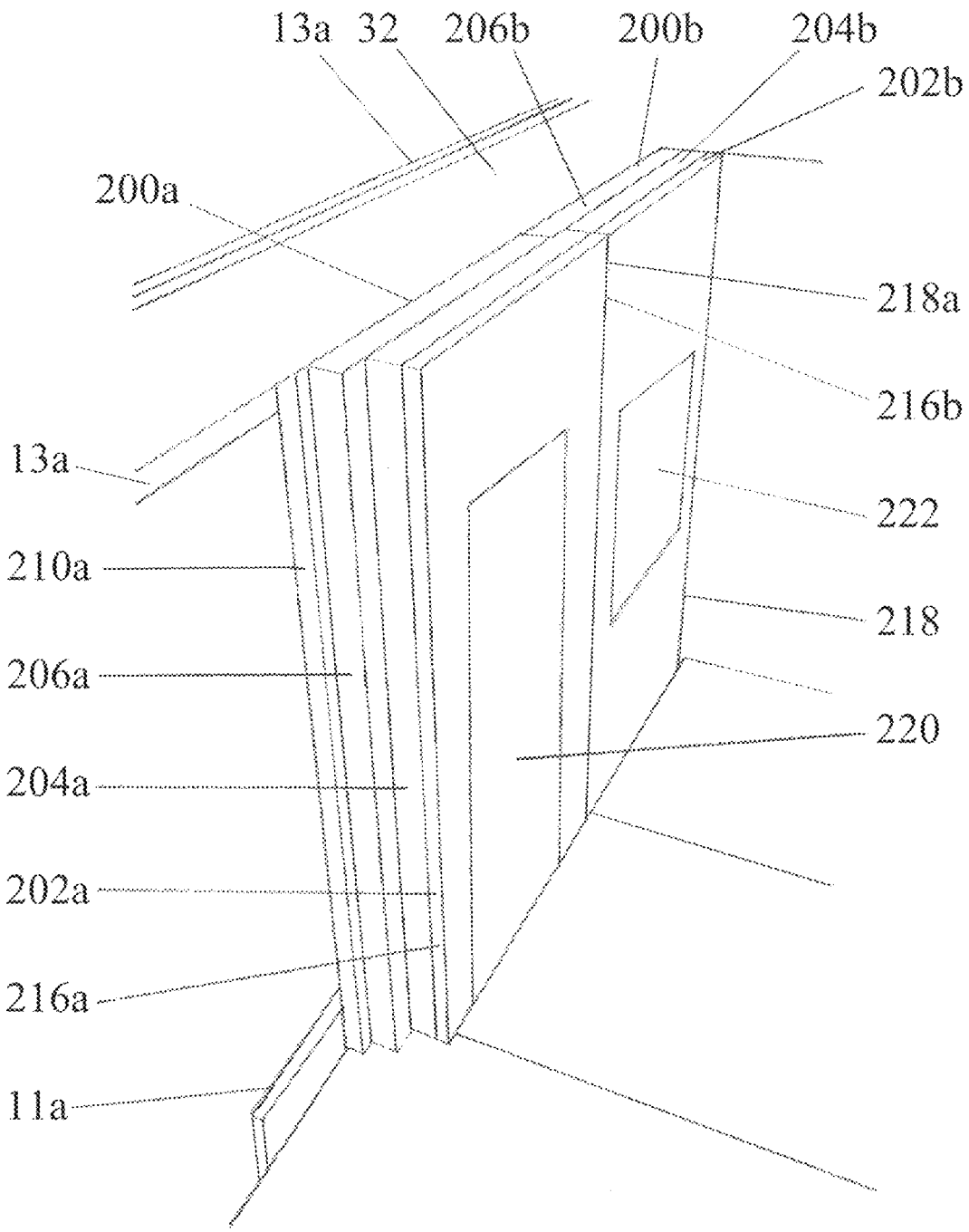
FIG. 10 is a perspective view of adjacent wall panels.

FIG. 10 is a perspective view showing to adjacent wall panels 200*a* and 200*b*. The offset of second insulation panels 206*a* and 206*b* forms a step in wall panels 200*a* and 200*b* into which the adjacent wall panel fits. As shown in FIG. 10, a step is formed along first side edge 216*b* of wall panel 200*b* because second insulation panel 206*b* is offset from first insulation panel 204*b*. First insulation panel 204*a* and interior panel 202*a* fit within this step. In this way, an air seal is formed in walls formed by wall panels 200. Additionally, because the insulation panels extend the full length of each wall, there is no thermal bridging and there is continual insulation along the entire length of each wall.

Wall panels 200*a* and 200*b* can be attached to one another by panel connecting support 210*b*. Panel connecting support 210 helps with the air seal formed in the walls. Panel connecting support 210 also assists in making the wall panels flush with each other. FIG. 10 also shows door 220 and window 222.

One or more wall panels 200 can form a wall of the building module. In some embodiments, each wall panel 200 can be built and then installed as a single unit. Additionally, each wall panel 200 can be removed as a single unit. That is, each wall panel 200 can be removed in whole. For example, if a building module included three adjacent wall panels and the middle wall panel was damaged, the middle wall panel could be removed as a single unit leaving the wall panels on either side in place. The middle wall panel could then be repaired and set back into place. If the wall panel could not be repaired, a new wall panel could be positioned in its place.

Turing back to FIG. 2, top wing 13*a* and bottom wing 11*a* assist in connecting wall panel 200*a* to building module 10. Top wing 13*a* extends downward from lengthwise roof support 32. In some embodiments, the top edge of top wing 13*a* is flush with the top edge of lengthwise roof support 32 so as to form a level or flat surface. Top wing 13*a* is wider than lengthwise roof support 32 so that top wing 13*a* extends below the bottom edge of lengthwise roof support 32.

Bottom wing 11*a* extends upwards from lengthwise base support 44 and bottom wing 11*b* extends upwards from lengthwise base support 42. In some embodiments, the bottom edge of bottom wing 11*a* is flush with the bottom edge of lengthwise base support 44 so as to form a level or flat surface. Bottom wing 11*a* is wider than lengthwise base support 44 so that bottom wing 11*a* extends above the top surface of lengthwise base support 44. A top wing and bottom wing having the same configuration are present on the opposite side of building module 10. Bottom wing 11*b* and lengthwise base support 42 have a similar configuration.

Top wing 13*a* and bottom wing 11*a* can be formed from 10 foot sections of plywood. Alternatively, they can be 8 foot sections having 16 inches in width. In some configurations, top wing 13*a* and bottom wing 11*a* extend the full length of building module 10. In other embodiments, top wing 13*a* and bottom wing 11*a* are formed from a continuous sheet of plywood. Top wing 13*a* and bottom wing 11*a* create room for utilities by creating a space between wall panel 200*a* and siding 22.

Floor panels 71 extend between the interior surfaces of bottom wings 11*a* and 11*b*. Floor panel 71 is supported from underneath by base support 40.

Wall panel 200*a* sits on top of floor panel 71. More specifically, bottom edge 214 of wall panel 200*a* rests on floor panel 71. Top wing 13*a* overlaps with a portion of wall panel 200*a* towards the top of wall panel 200*a*. Top wing 13*a* can be connected to wall panel 200*a* by fastening top wing 13*a* to panel support 208 and panel connecting support 210 with for example screws or nails. Bottom wing 11*a* overlaps with a portion of wall panel 200*b* towards the bottom of wall panel 200*a*. Bottom wing 11*a* can be connected to wall panel 200*a* by fastening bottom wing 11*a* to panel support 208 and panel connecting support 210 with for example screws or nails.

A door or window can be added into wall panel 200 by cutting the appropriate opening in wall panel 200 and inserting the desired accessory. In some embodiments, wall panel 200 provides sufficient support for the accessory (i.e., window, door) and no additional support needs to be added to wall panel 200.

Additional insulating panels can be added to wall panels 200 by removing interior panel 202, adding additional insulating panels and reinstalling interior panel. In this way, the degree of insultation in building module 10 can be altered at any time, including after the initial construction of building module 10.

An outer covering, such as siding, is attached to panel support 208 and panel connecting support 210 to protect wall panels 200 from the elements and to enclose building module 10. In some embodiments, utilities, such as electric and water, can be run in the space formed by panel support 208, panel connecting support 210, and wings 11 and 13 between second insulation panel 206 and outer covering. Utility accessories such as electrical outlets and light switches for electricity and sinks for water can be added at any time, including after the initial construction. For example, an electrical outlet can be added by cutting the appropriate sized hole in wall panel 200, adding an electrical outlet and wiring the electrical outlet with electrical power.

A wall panel 200 can be repaired or replaced after initial construction by unfastening wall panel 200 from building module 10 and either repairing and reattaching or attaching a new wall panel 200. Wall panel 200 can also be moved. The wall panels 200 form an adaptive wall system which allows removal or repositioning of individual wall panels, before or after the building is completed.

Building codes vary by community. For example, stud requirements in building codes vary by community. To accommodate these differences, modifications can be made to adjust the roof, walls and flooring. For example, additional studs (i.e., panel supports 208), additional rafters and/or floor supports can be added to meet codes. Additionally, insulation can be varied by material and/or depth in addition to alternate inside and outside wall coverings.

Figure 11:
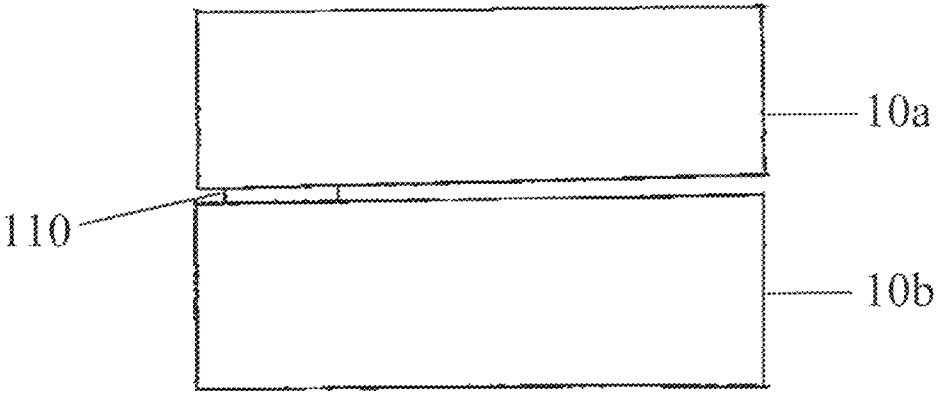
FIGS. 11-14 are schematic top view diagrams of exemplary configurations with multiple building modules.

FIG. 11 is a schematic top view diagram illustrating two building modules, 10*a* and 10*b*, positioned side-by-side as part of a single building system. As shown in FIG. 11, portions of the adjoining walls can be removed and a coupler 110 can be added such that the interior spaces of first building module 10*a* and second building module 10*b* are in communication with each other.

Figure 12:
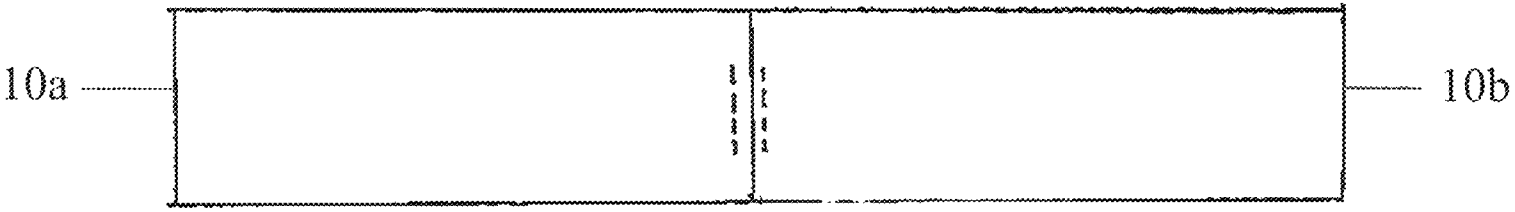

FIG. 12 is a schematic top view diagram illustrating two building modules, 10*a* and 10*b*, positioned end-to-end. Portions of the outside steel and the adjoining walls (marked in dashed lines in FIG. 12) can be removed so the interior spaces of first building module 10*a* and second building module 10*b* are in communication with each other and form a single interior space. Alternatively, the outside steel can be removed and a door installed in one of the adjoining wall panels. In this way, the interior spaces of first building module 10*a* and second building module 10*b* are connected but can be portioned separately, for example to control temperature or to reduce sound.

Figure 13:
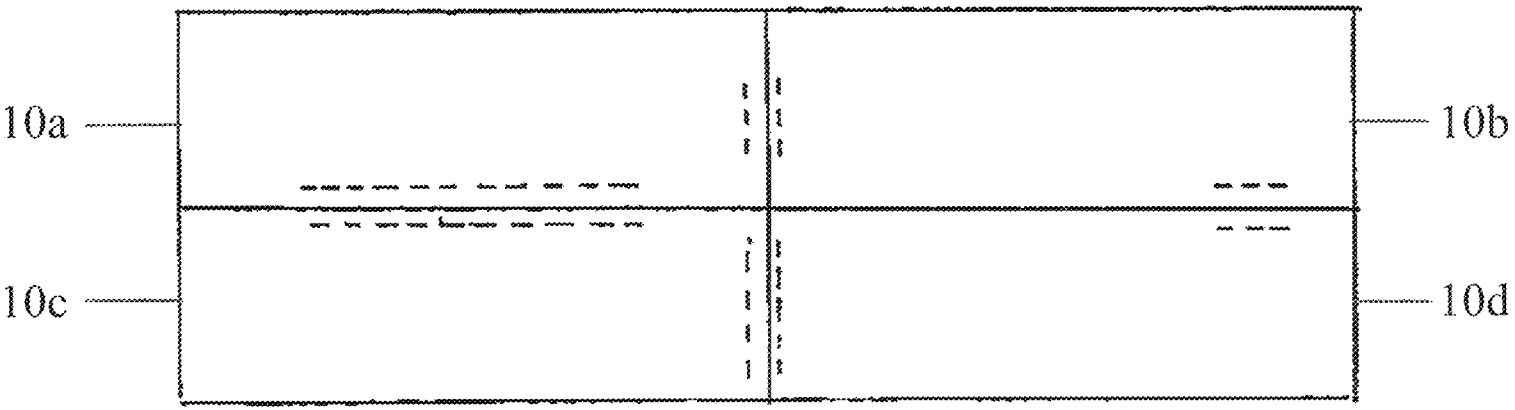

FIG. 13 is a schematic top view diagram illustrating four building modules, 10*a*, 10*b*, 10*c* and 10*d*, positioned to form a rectangle. Building modules 10*a* and 10*b* are positioned end-to-end as described above in FIG. 12. Similarly, modules 10*c* and 10*d* are positioned end-to-end. Further, building modules 10*a* and 10*c* are positioned side-by-side and building modules 10*b* and 10*d* are positioned side by side. Portions of adjacent walls (marked in dashed lines in FIG. 13) can be removed so that the interior of all four modules are in communication with each other and form a single interior space.

Figure 14:
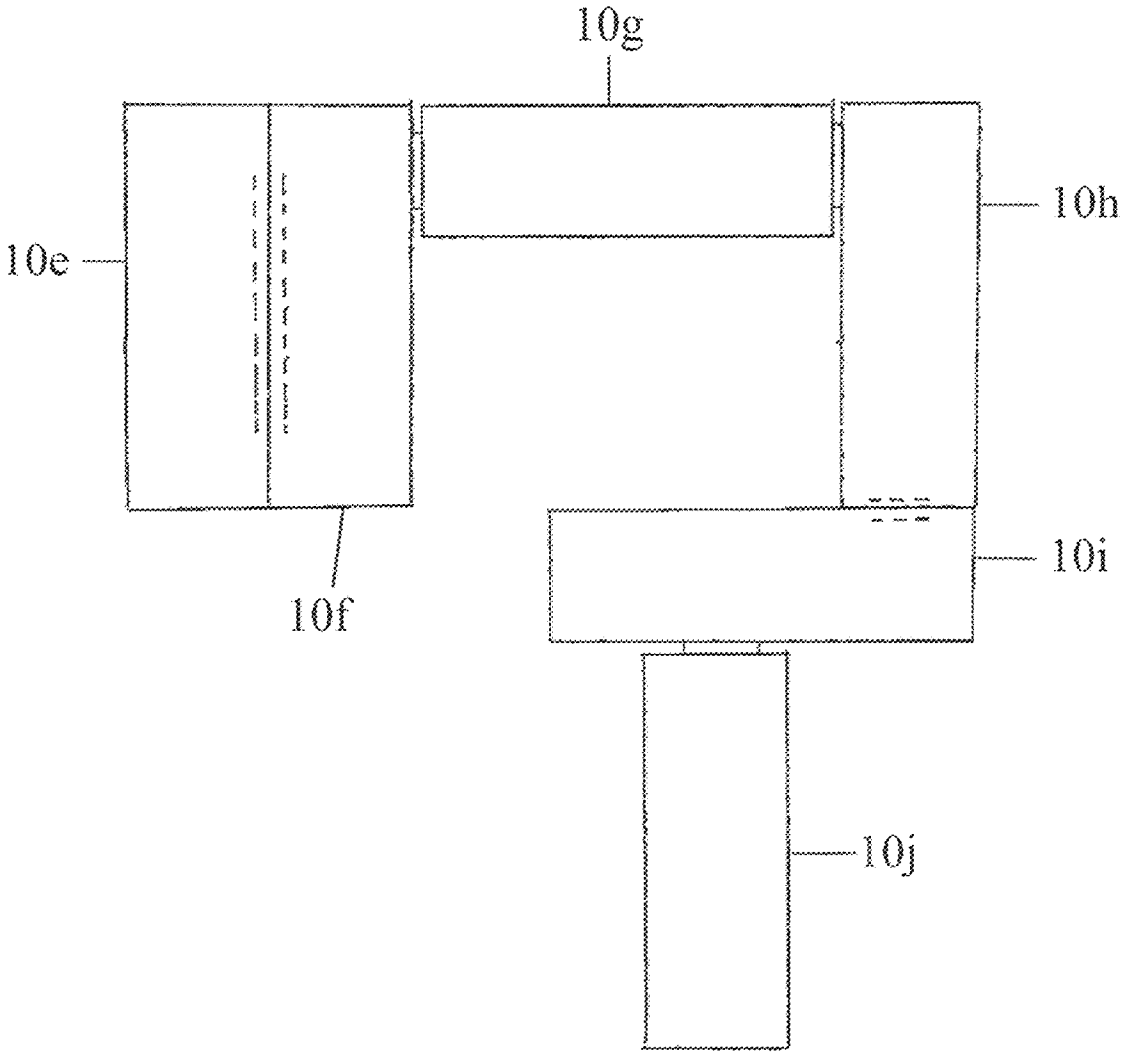

FIG. 14 is a schematic top view diagram illustrating six building modules, 10*e*, 10*f*, 10*g*, 10*h*, 10*i*, and 10*j* positioned to form a building system having an interior courtyard. Building modules 10*e* and 10*f* are positioned side-by-side. The end of building module 10*g* connects to the side of building module 10*f* and the other end of building module 10*g* connects to the side of building module 10*h*. The end of building module 10*h* connects to the side of building module 10*i*. As illustrated with building module 10*j*, the building modules can be connected at any location by removal of a wall panel.

The invention of the current application allows one or more wall panels of adjacent walls to be removed. In this way, a number of different and unique floor plans can be created. Further, the current invention allows wall panels to be removed or replaced after the initial build. This allows the overall building to be re-configured (e.g., the removal or addition of walls or portions of walls) even after the initial build. Additionally, the structure/engineering combats deflection of boards in all directions. Meaning, the combination and placement of each set of boards with conjunction with plywood and other parts, combats deflection of the various individual boards as well as pieces.

In some embodiments, all lumber used in the building system and each building module is standard lumber available commercially which eliminates the need to cut lumber to build the module(s). Standard size lumber has been specifically mentioned herein and include the following boards at least in the United States: 2×4, 2×6, 2×12, 4×6, and 6×6.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A building module system comprising a building module, the building module comprising:

a base support comprising:

a frame having rectangular shape with a first side, a second side, a first end and a second end, the frame formed by a first lengthwise base support connected to a first end of a first cross support and to a first end of a second cross support and a second lengthwise base support connected to a second end of the first cross support and to a second end of the second cross support;

a subfloor connected to the frame and extending from the first side to the second side and from the first end to the second end;

floor supports positioned above the subfloor, each floor support extending from the first side to the second side of the frame;

a first bottom wing having a first side and a second side opposite the first side, the first side of the first bottom wing connected to and extending upwards from the first lengthwise base support of the frame;

a second bottom wing having a first side and a second side opposite the first side, the first side of the second bottom wing connected to and extending upwards from the second lengthwise base support of the frame;

a plurality of flooring panels positioned above and supported by the floor supports, each flooring panel extending from the first side to the second side of the frame and the flooring panels together extending from the first end to the second end of the frame;

a roof support spaced apart from the base support and having a rectangular shape with a first side, a second side, a first end and a second end, the roof support formed by a first lengthwise roof support connected to a first end of a first roof cross support and a first end of a second roof cross support and a second lengthwise roof support connected to a second end of the first roof cross support and a second end of the second roof cross support;

a plurality of ceiling panels attached to the roof support;

rafter module having a width and connected to the roof support, the rafter module comprising:

a plurality of webs extending in a first direction and spaced apart from one another in a second direction, each web having a top surface, a bottom surface, a first end, a second end and spanning the width of the rafter module;

a plurality of chords spaced apart from one another in the first direction and extending in the second direction, wherein each chord is connected to the top surface of each of the webs; and a bottom chord connected to the bottom surface of each of the webs at the second end, the bottom chord creating a slope so that the second ends of the webs are higher than the first ends of the webs, wherein the first direction is perpendicular to the second direction;

a first top wing having a first side and a second side opposite the first side, the first side of the first top wing connected to and extending downward from the first lengthwise roof support of the roof support;

a second top wing having a first side and a second side opposite the first side, the first side of the second top wing connected to and extending downward from the second lengthwise roof support of the roof support; and vertical supports extending vertically between the base support and the roof support and connecting the base support and the roof support;

a plurality of wall panels connected to and extending from the first side of the first top wing to the first side of the first bottom wing and from the first side of the second top wing to the first side of the second bottom wing, a bottom surface of each of the plurality of wall panels resting on at least one flooring panel; and a plurality of siding panels connected to and extending from the second side of the first top wing to the second side of the first bottom wing and from the second side of the second top wing to the second side of the second bottom wing, wherein the wall panels are spaced apart from the siding panels.

2. The building module system of claim 1 wherein the wall panels include at least a first wall panel and a second wall panel, each of the first wall panel and the second wall panel including:

an interior panel having a top interior panel edge, a bottom interior panel edge, a first side interior panel edge and a second side interior panel edge;

a first insulating panel connected to the interior panel, the first insulating panel having a top first insulating panel edge aligned with the top interior panel edge, a bottom first insulating panel edge aligned with the bottom interior panel edge, a first side first insulating panel edge aligned with the first side interior panel edge and a second side first insulating panel edge aligned with the second side interior panel edge; and a second insulating panel connected to the first insulating panel, the second insulating panel having a top second insulating panel edge aligned with the top first insulating panel edge, a bottom second insulating panel edge aligned with the bottom interior panel edge, a first side second insulating panel edge not aligned with the first side first insulating panel edge and forming a protrusion, and a second side second insulating panel edge not aligned with the second side first insulating panel edge and forming a notch, wherein the protrusion of the first wall panel fits within the notch of the second wall panel and a portion of the first wall panel overlaps with a portion of the second wall panel.

3. The building module system of claim 2 and further including a panel connecting support connected to the second insulating panel of the first wall panel and the second insulating panel of the second wall panel.

4. The building module system of claim 2 wherein the first wall panel and the second wall panel are removable in whole.

5. The building module system of claim 2 wherein a window or a door is positioned within the first wall panel and is in communication with the interior panel, the first insulating panel and the second insulating panel.

6. The building module system of claim 1 and further comprising a plurality of rafter modules connected to one another.

7. The building module system of claim 1 and further comprising a second building module connected to the building module.

* * * * *